US006024267A

United States Patent [19]

Chen

[11] Patent Number: 6,024,267

[45] Date of Patent: Feb. 15, 2000

[54] STAPLER HAVING AN ADJUSTABLE NAILING STROKE

[76] Inventor: Cheu Fa Chen, No. 24, Kung Yeh Dist., 36th Rd., Shi Tun Dist., Taichung, Taiwan

[21] Appl. No.: 09/063,906

[22] Filed: Apr. 21, 1998

[30] Foreign Application Priority Data

Apr. 25, 1997 [TW] Taiwan ..... 86206585

[51] Int. Cl.[7] ..... B25C 1/04

[52] U.S. Cl. ..... 227/8; 227/142

[58] Field of Search ..... 227/8, 142, 130

[56] References Cited

U.S. PATENT DOCUMENTS

| | | | |
|---|---|---|---|
| 5,219,110 | 6/1993 | Mukoyama | 227/8 |
| 5,368,213 | 11/1994 | Massari, Jr. . | |
| 5,385,286 | 1/1995 | Johnson, Jr. | 227/142 |
| 5,579,977 | 12/1996 | Yang | 227/8 |
| 5,685,473 | 11/1997 | Shkolnikov et al. | 227/142 |
| 5,715,982 | 2/1998 | Adachi | 227/130 |
| 5,785,227 | 7/1998 | Akiba | 227/142 |

FOREIGN PATENT DOCUMENTS 2178355 2/1987 United Kingdom .

*Primary Examiner*—Scott A. Smith
*Attorney, Agent, or Firm*—Charles E. Baxley, Esq.

[57] ABSTRACT

A stapler includes a nose portion for engaging with a work piece and includes a safety. A sleeve is slidably engaged on the nose portion. A guide is secured to the safety and a shaft rotatably secured to the guide. A rod is secured to the sleeve and has an outer thread threadedly engaged with the shaft for allowing the sleeve and the rod to be adjusted and moved relative to the shaft and the guide when the shaft is rotated relative to the rod. A control ferrule is rotatably engaged with the guide and secured to the shaft for rotating the shaft relative to the rod and for adjusting the sleeve relative to the nose portion, such that the nose portion may he adjusted relative to the work piece.

3 Claims, 3 Drawing Sheets

STAPLER HAVING AN ADJUSTABLE NAILING STROKE

BACKGROUND OF THE INVENTION

1. Field of the Invention

The present invention relates to a stapler, and more particularly to a stapler having an adjustable nailing stroke.

2. Description of the Prior Art

Typical staplers comprise a safety for engaging with a work piece and for disabling the trigger of the stapler unless the stapler is in its actuated position with nose portion in contact with the work piece; i.e., the stapler may not be operated unless the trigger and the safety are actuated at the same time. Two typical safety devices are disclosed in UK Patent Application No. GB 2178355 A to Monacelli and U.S. Pat. No. 5,368,213 to Massari, Jr. However, the nailing strokes may not be adjusted; i.e., the moving stroke of the nails or staples relative to the work piece may not be adjusted.

The present invention has arisen to mitigate and/or obviate the afore-described disadvantages of the conventional staplers.

SUMMARY OF THE INVENTION

The primary objective of the present invention is to provide a stapler which may be easily adjusted to different nailing strokes.

In accordance with one aspect of the invention, there is provided a stapler includes a nose portion for engaging with a work piece and for stapling the work piece with nails, the stapler further comprises means for adjusting the nose portion of the stapler relative to the work piece.

The stapler includes a safety secured thereto, the nose portion adjusting means includes a sleeve slidably engaged on the nose portion and a sleeve adjusting means for adjusting the sleeve relative to the safety. The sleeve adjusting means includes a guide secured to the safety, and means for adjusting the sleeve relative to the guide. The guide includes a shaft rotatably secured thereto, the shaft includes a first end having a first thread device, a rod secured to the sleeve and having a second thread device for threadedly engaging with the first thread device and for allowing the sleeve and the rod to be adjusted and moved relative to the shaft and the guide when the shaft is rotated relative to the rod. A rotating means is further provided for rotating the shaft. The guide includes a frame having an opening and includes a control ferrule rotatably engaged in the opening and secured to the shaft for allowing the control ferrule to be rotated in concert with the shaft and for allowing the shaft to be rotated relative to the rod by the control ferrule. A positioning means is further provided for positioning the control ferrule to the frame of the guide.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
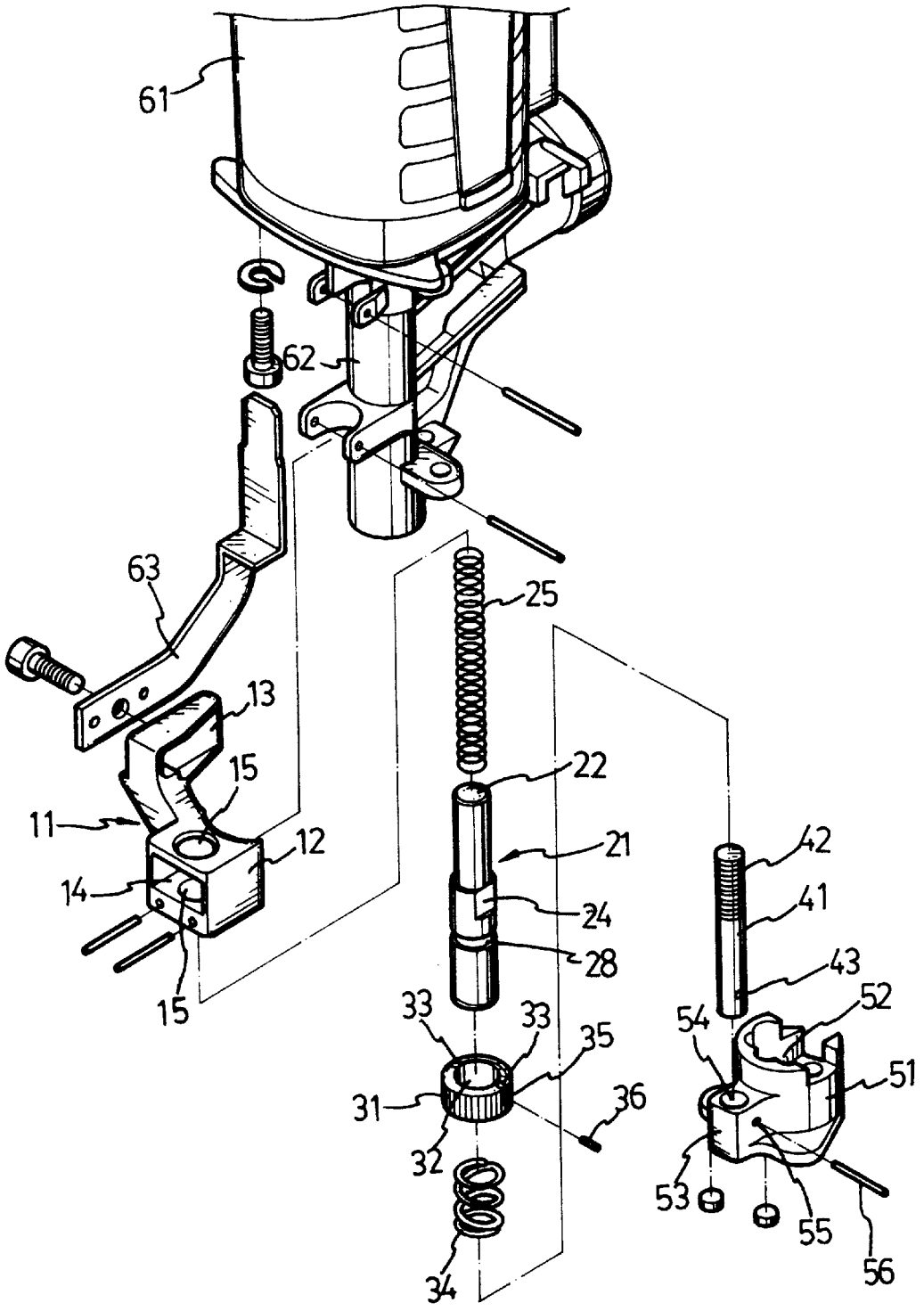
FIG. 1 is an exploded view of a stapler in accordance with the present invention.
Figure 2:
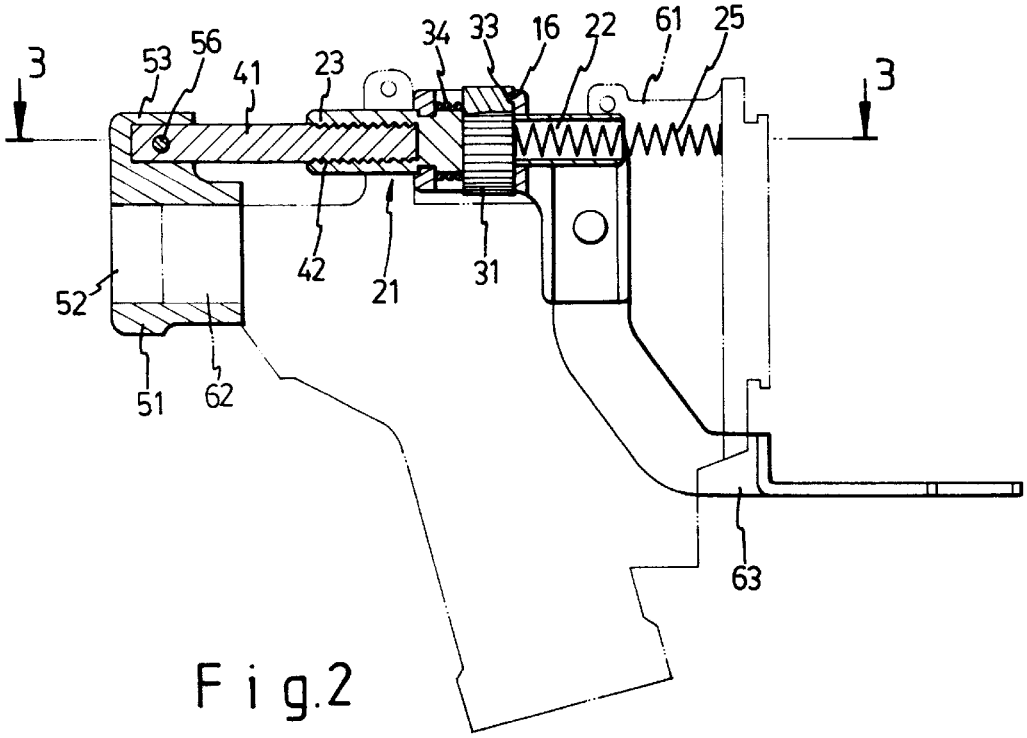
FIG. 2 is a cross sectional view taken along lines 2—2 of FIG. 3.
Figure 3:
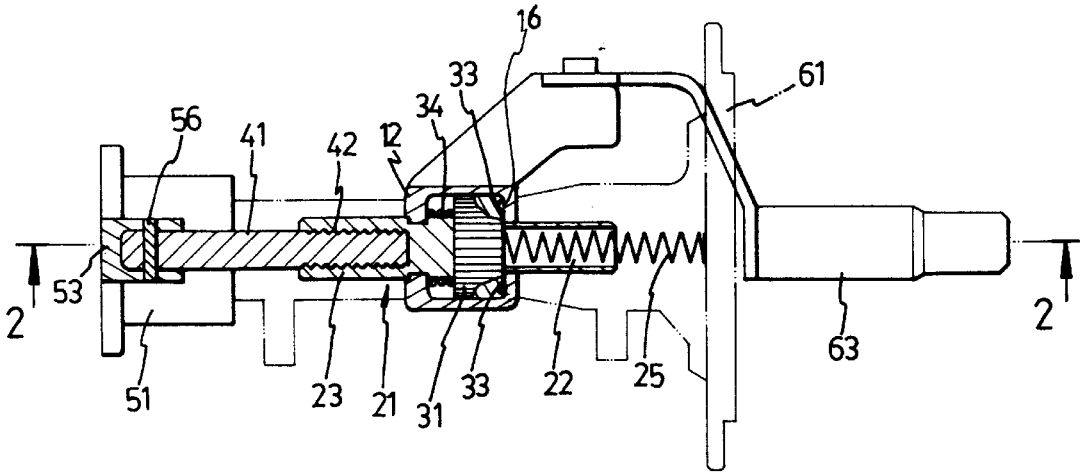
FIG. 3 is a cross sectional view taken along lines 3—3 of FIG. 2.

Referring to the drawings, and initially to FIGS. 1–3, a stapler in accordance with the present invention comprises a body 61 having a nose portion 62 for driving the nails or staples into the work piece. A safety 63 is secured to the body 61. The configuration and the operation of the safety 63 are typical and will not be described in further details. A guide 11 includes a frame 12 having an opening 14 for rotatably receiving a control ferrule 31 and includes one end 13 for securing to the safety 63 by such as fasteners. The frame 12 includes an orifice 15 intersecting with the opening 14, for rotatably receiving a shaft 21 which includes an annular groove 28 for engaging with the frame 12 (FIGS. 2–5). The annular groove 28 of the shaft 21 may be engaged with the frame 12 by forcing the shaft 21 into the orifice 15 of the frame 12. One end of the shaft 21 includes a hole 22 for receiving one end of a spring 25 which has the other end engaged with the body 61 and which is provided for biasing the safety 63 via the shaft 21 and the guide 11. The shaft 21 includes a flat surface 24 formed in the middle portion.

The control ferrule 31 includes a bore 32 for engaging with the shaft 21 and includes a hole 35 for engaging with a fastener 36 which is engaged with the flat surface 24 of the shaft 21, such that the control ferrule 31 may be secured to the shaft 21 and rotated in concert with the shaft 21, and such that the shaft 21 may be rotated by the control ferrule 31. The control ferrule 31 includes one or more depressions 33 formed in one end surface. The guide 11 includes one or more projections 16 (FIGS. 2, 3) for engaging with the depressions 33 and for positioning the control ferrule 31 relative to the guide 11. A spring 34 is engaged between the frame 12 and the control ferrule 31 for biasing the control ferrule 31 to engage with the projection(s) 16. The projection(s) 16 may be disengaged from the depressions 33 of the control ferrule 31 against the spring 34 such that the control ferrule 31 may be rotated relative to the frame 12 and may be positioned relative to the frame 12 again when the projection(s) 16 are engaged with the other depressions 33.

A sleeve 51 includes an aperture 52 for slidably receiving the nose portion 62 of the stapler and includes a swelling 53 laterally extended outward. The swelling 53 includes a hole 54 for engaging with one end of a rod 41 and includes a puncture 55 for engaging with a fastener 56, such as a fastening pin. The fastener 56 is engaged through a hole 43 of the rod 41 for securing the rod 41 to the sleeve 51. The rod 41 includes an outer thread 42 formed on the other end for engaging with an inner thread or a screw hole 23 that is formed in the other end of the shaft 21 opposite to the spring 25. The sleeve 51 is provided for engaging with the work piece to be stapled.

Figure 4:
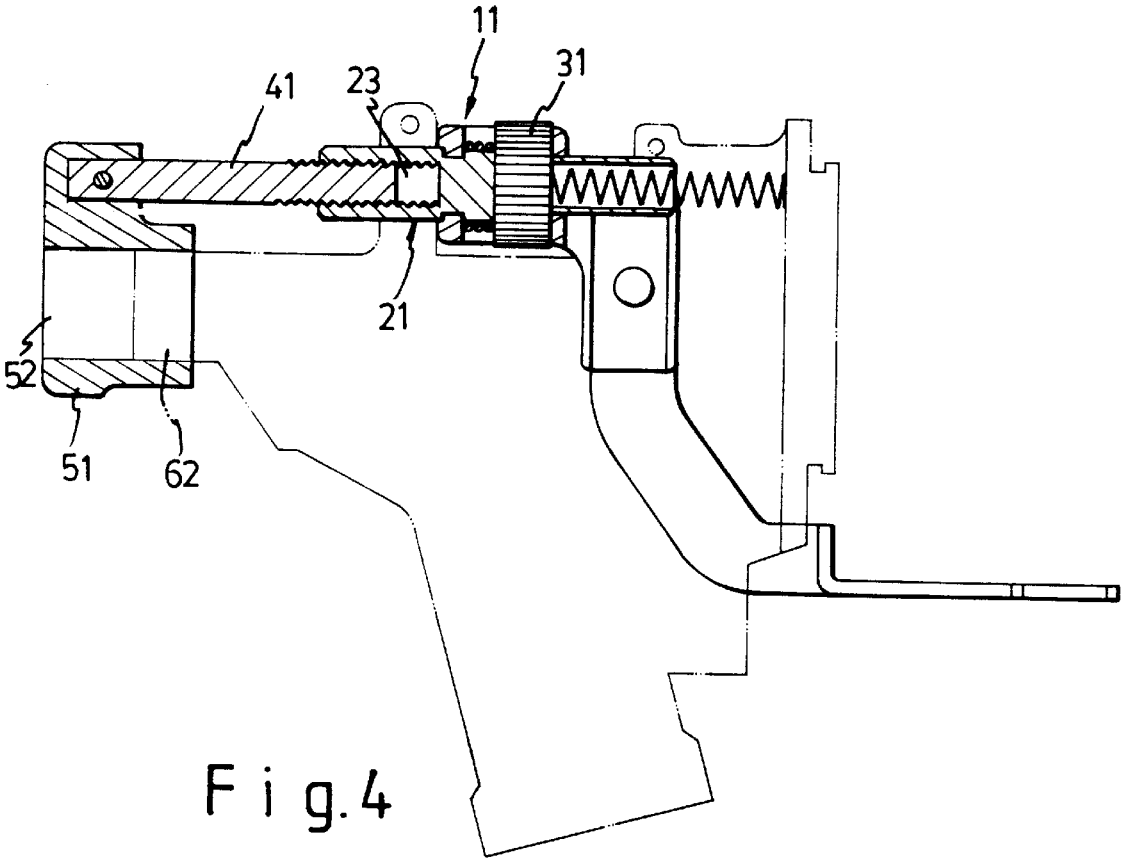
FIGS. 4, 5 are cross sectional views similar to FIGS. 2 and 3 respectively, illustrating the operation of the stapler.
Figure 5:
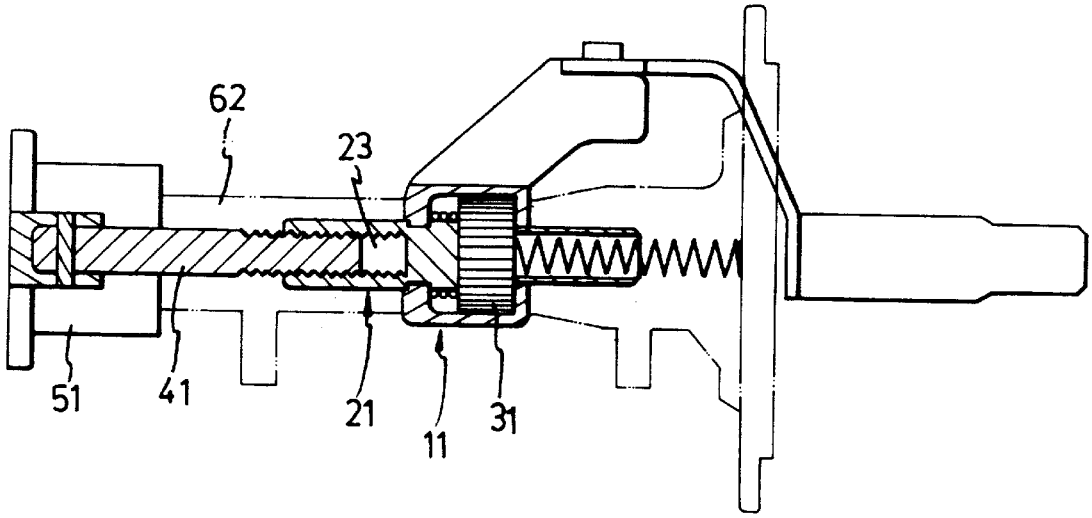

In operation, as shown in FIGS. 4 and 5, the shaft 21 may be rotated by the control ferrule 31, such that the rod 41 may be caused to move relative to the shaft 21 by the threaded engagement between the outer thread 42 and the inner thread 23. The sleeve 51 is slidably engaged with the nose portion 62 and the rod 41 is secured to the sleeve 51, such that the sleeve 51 may not be rotated relative to the nose portion 62 and such that the sleeve 51 may be adjusted and moved along the nose portion 62. The sleeve 51 will be engaged with the work piece and the sleeve 51 may be adjusted relative to the nose portion 62 such that the nailing stroke of the nails or staples may be adjusted.

Accordingly, the stapler in accordance with the present invention may be easily adjusted to different nailing strokes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapler including a stapler body having a nose portion for engaging with a work piece and for stapling the work piece with nails, said stapler comprising:

a safety secured to said stapler body;

a sleeve slidably engaged on the nose portion of said stapler;

a guide secured to said safety and including a frame having an opening formed therein;

a shaft rotatably engaged through said frame and engaged through said opening of said guide, said shaft including a first end having a first thread device provided therein;

a rod secured to said sleeve and including a second thread device provided therein for threadedly engaging with said first thread device of said shaft and for allowing said sleeve and said rod to be adjusted and moved relative to said shaft and said guide when said shaft is rotated relative to said rod; and a control ferrule rotatably received in said opening of said frame and secured to said shaft and rotated in concert with said shaft for rotating said shaft relative to the rod to adjust and to move said sleeve and said rod relative to said shaft and said guide.

2. The stapler according to claim 1 further comprising means for positioning said control ferrule to said frame of said guide.

3. The stapler according to claim 2, wherein said control ferrule includes at least one depression formed therein, said positioning means includes at least one projection extended from said frame of said guide and engaged into said at least one depression of said control ferrule for positioning said control ferrule to said frame of said guide.

* * * * *